United States Patent [19]

Brown

[11] 4,290,608

[45] Sep. 22, 1981

[54] LOBSTER TRAP GAME

[76] Inventor: Robert O. Brown, Nautilus Rd., Gloucester, Mass. 01930

[21] Appl. No.: 82,071

[22] Filed: Oct. 5, 1979

[51] Int. Cl.[3] ..... A63F 3/00

[52] U.S. Cl. ..... 273/256; 273/244; 273/282; 273/288

[58] Field of Search ..... 273/244, 246, 252, 243, 273/256

[56] References Cited

U.S. PATENT DOCUMENTS

| | | | |
|---|---|---|---|
| 1,564,458 | 12/1925 | Whiting | 273/246 |
| 1,574,394 | 2/1926 | Holme | 273/252 |
| 2,577,961 | 12/1951 | Graves | 273/246 |
| 3,656,757 | 4/1972 | Carroll | 273/256 |
| 3,921,981 | 11/1975 | Ashburn | 273/244 |
| 4,003,578 | 1/1977 | Jones | 273/244 |

FOREIGN PATENT DOCUMENTS

| | | | |
|---|---|---|---|
| 7202 | of 1894 | United Kingdom | 273/244 |
| 567020 | 1/1945 | United Kingdom | 273/246 |

*Primary Examiner*—Richard C. Pinkham
*Assistant Examiner*—R. Carl Moy
*Attorney, Agent, or Firm*—William Nitkin

[57] ABSTRACT

A game having a gameboard depicting a coastal harbor with lobster boat player pieces, lobster trap indicia markers, and chance means for determining the amount of lobsters caught when the lobster trap indicia markers are set on designated spaces of the ocean area of the gameboard.

2 Claims, 3 Drawing Figures

10

LOBSTER TRAP GAME

BACKGROUND OF THE INVENTION

1. Field of the Invention

The game of this invention resides in the area of board games and more particularly relates to a game depicting a coastal harbor and having player pieces adapted to set lobster traps in order for a player to catch by a combination of skill and chance the greatest poundage of lobsters.

2. History of the Prior Art

While games do exist depicting sailing ships moving across ocean areas depicted on gameboards, the inventor herein is unaware of any games which depict the commercial catching of lobsters.

SUMMARY

It is an object of the game of this invention to depict commercial lobstering practices and to provide an exciting game using both skill and chance to allow competing players to see who can catch the greatest poundage of lobsters.

A game board is utilized having a portion thereof designating ocean area with a grid interposed thereover designating spaces into which one lobster boat may be moved upon chance selection of a number of spaces by utilization of number selection means such as dice. Along the edges of the game board are depicted land areas and at one end is depicted six docking areas for the lobster boat pieces. Further within certain spaces are depicted rocks which during low tide can, in some instances, strand a lobster boat thereon if it is positioned on such space when a timer goes off at a preselected time indicating a changing of the tides. Further seen on the gameboard is a breakwater and a number of designations of lobster trap receipt areas. These receipt areas can be in the form of apertures adapted to receive colored lobster trap indicia representative of lobster traps so that a player will know when he has placed his trap by the color of the flag inserted in the lobster trap receipt area. In practice each player is given $1,030.00 in play money and one of them is designated the banker and the time keeper. At the start of play the timer is set at 15 minutes during which 15 minutes the tide is high and the lobster boats may be moved to any space on the gameboard. The timer is placed out of view of the players so that they must rely on their instincts as to when the time will run up and the tide change. A player rolls one of the dice in order to determine the market price per pound of lobster. This price determination must be done at each high tide. One of the players is designated to start the game by chance selection means usually by rolling the dice. To start, each player must roll a pure six in order to start to move his boat away its dock which means that some boats will move out before others. For each boat that leaves the dock, its owner must pay the bank a $30.00 bait fee. This fee is paid at the beginning of each trip that a boat makes. The player then rolls the dice and can only move in one direction. The player may have three choices of the number of spaces he moves. For instance, if the dice thrown is a 3 and a 4, the player may move either 3 spaces, 4 spaces or 7 spaces. A player cannot skip his move. The lobster boat player pieces in some embodiments can be only moved vertically and/or horizontally while in other embodiments of the gameboard, the players may also move diagonally. The type of movement depends on the grid design of the surface of the gameboard as will be discussed below. In order to set a lobster trap, a player must land on an adjacent space to where a lobster trap receipt area is located. In some embodiments there may be some spaces where a player can set two traps if he so desires. The player must set all six lobster traps which are carried on the boat before returning to his home dock. Once the lobster boat has docked, it can start out again to pick up its traps. When a player retrieves each trap, he takes one card from the Pot Luck Deck which indicates thereon the number of pounds that are in the lobster trap that he has retrieved. The Pot Luck Deck is comprised of a plurality of cards, each of which indicates lobster weight recoveries from the trap so that it is solely determined by chance the weight of lobsters in a retrieved lobster trap once it is recovered. When the alarm timer goes off indicating the end of high tide, and a lobster boat is on a space with a rock depicted therein, the player whose boat piece is "on the rocks" must take a card from the On The Rocks Deck which contains a plurality of cards indicating the fate of the vessel. The On The Rocks Cards may direct, for example, that the player go to the marine railway to have the vessel repaired, that the boat float off the rocks or that divers must examine the bottom of the boat for damage and indicate the cost of each particular calamity which expense the player must pay to the bank. A typical game can consist of three trips out of the docking area, but it can be shortened to a lesser number of trips or lengthened to a greater number of trips. The number of trips is determined at the beginning of play. The price per pound of lobsters caught changes at each high tide. At the end of the game the player having the greatest poundage of lobsters caught is declared the winner. Both decks of cards are shuffled after each trip. It has been found that when playing a game of more than one trip, a player may proceed to the docking area any time after pulling up one or more of his traps and is then credited according to the market price determined by the throw of a single dice as discussed earlier times the pounds recovered and the total is then entered on a Trip Sheet and is considered one trip. These traps must be reset before any other traps are pulled. If one comes back to the docking area with one trap at a time, the trap must be replaced before any other traps can be pulled. If playing a one trip game, one must set and pull all six traps before going back to the dock for tallying. When a player has completed all his trips and pulled up all his traps and returned to his docking area, then every player must total his poundage of lobsters caught and whichever player has the highest total that player wins the game. During low tide which is the second time period which can be of 5 minutes duration after the first 15 minutes, no one may set or pull a trap or travel over a space which has a rock depicted on it. This low tide period allows a player who landed on a rock to have a fair chance to have his boat repaired and to catch up. Of course during low tide, a player may proceed home if he has a catch. Further, spaces can be designated on the other side of the breakwater furthest away from the docks for low tide setting of lobster traps since the water on the other side of the breakwater is deeper and a player could set his lobster pots without running aground. No player at any time may jump over another player's lobster boat. Players may attempt to block the movement of another player nearby hoping that the blocked player will run aground. The game can include three-dimensional pieces of the board such as the lobster boats. In one embodiment the buildings appearing on the board can be more realistically constructed of plastic as can be the dock and the breakwater. The gameboard in one embodiment can be of cardboard construction, but it also can be a sheet of flexible vinyl plastic and of a large size to assist in making the game more interesting. The flag lobster trap indicia as illustrated is only symbolic of the type of lobster traps that could be used and other embodiments of traps could be utilized. For example the boats could be made larger and could utilize miniature lobster traps which are placed on spaces designated as lobster trap receipt areas on the vinyl sheet. In one embodiment wherein the lobster trap flag indicia are used, the board should have sufficient thickness so that the indicia can be inserted into the lobster trap receipt apertures enabling a player to easily scan the gameboard to locate his flags by their color. It is the practice in lobstering for a lobsterman's lobster buoys to be of a single color to differentiate them from another's traps. It should be noted that there is an island in the middle of the gameboard between the breakwater and the docks which holds the Pot Luck Cards and the On The Rocks Cards. It has been found preferable to have the lobster trap receipt areas beyond this island as in most natural situations lobster boats must leave their docks and travel some distance before the lobstermen can set their lobster pots and return back to their docks.

DESCRIPTION OF THE PREFERRED EMBODIMENT(S)

Figure 1:
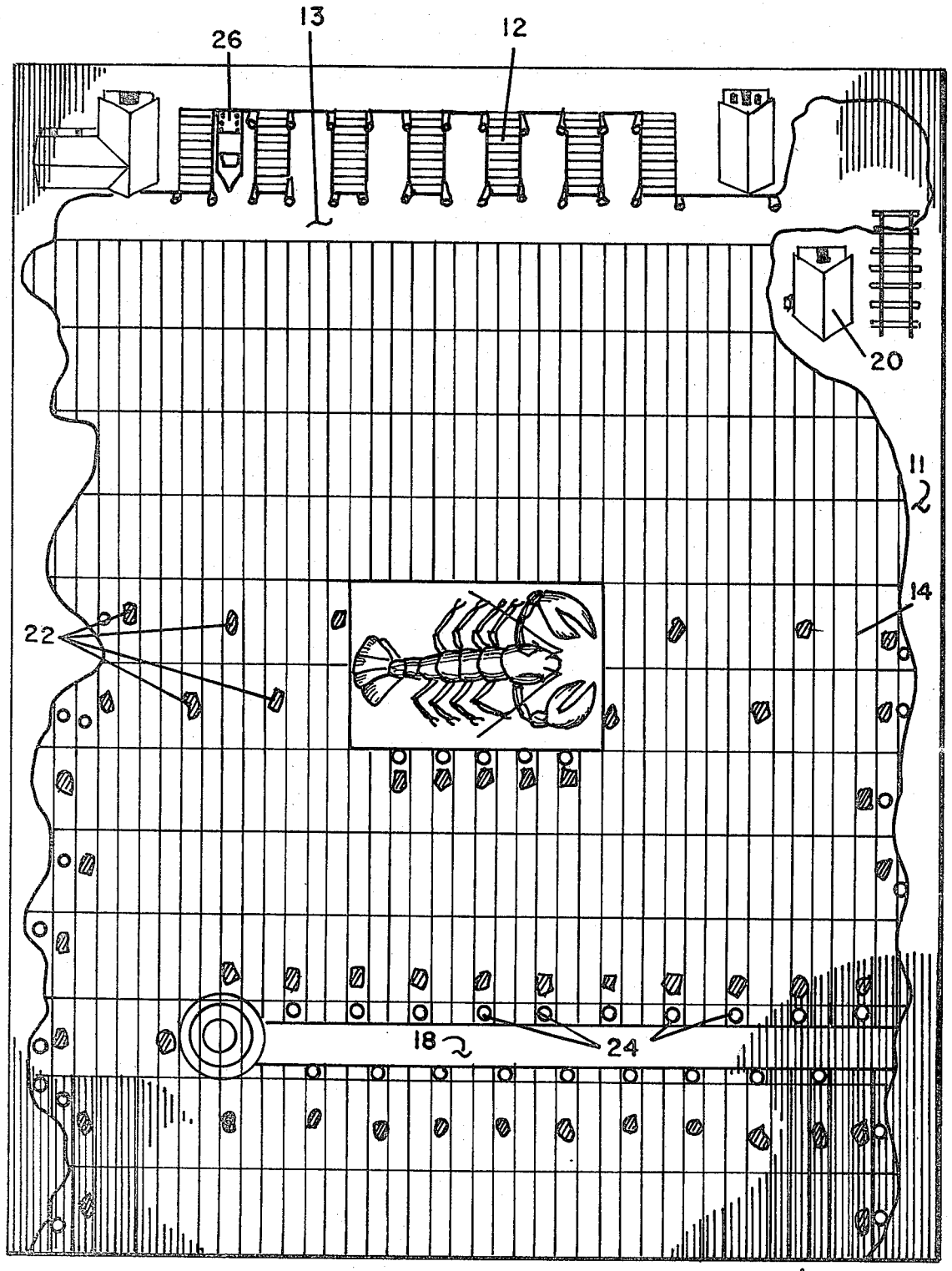
FIG. 1 illustrates a top view of the gameboard of this invention.
Figure 2:
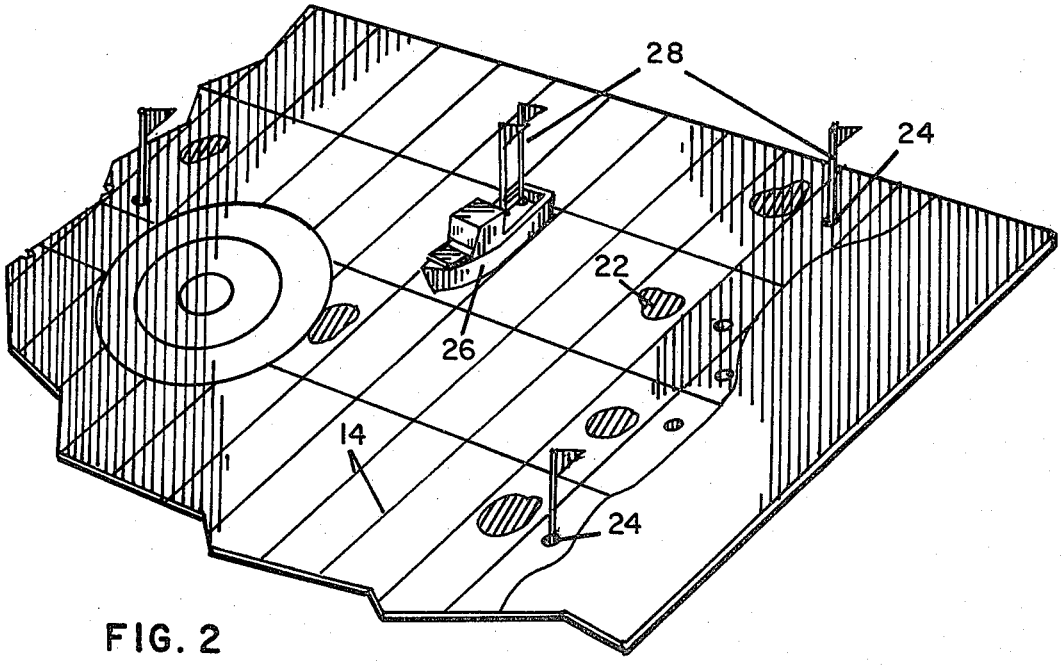
FIG. 2 illustrates a sectional view of the gameboard showing a lobster boat piece, a space with a rock depicted thereon and the placement of lobster trap indicia into lobster trap receipt areas.
Figure 3:
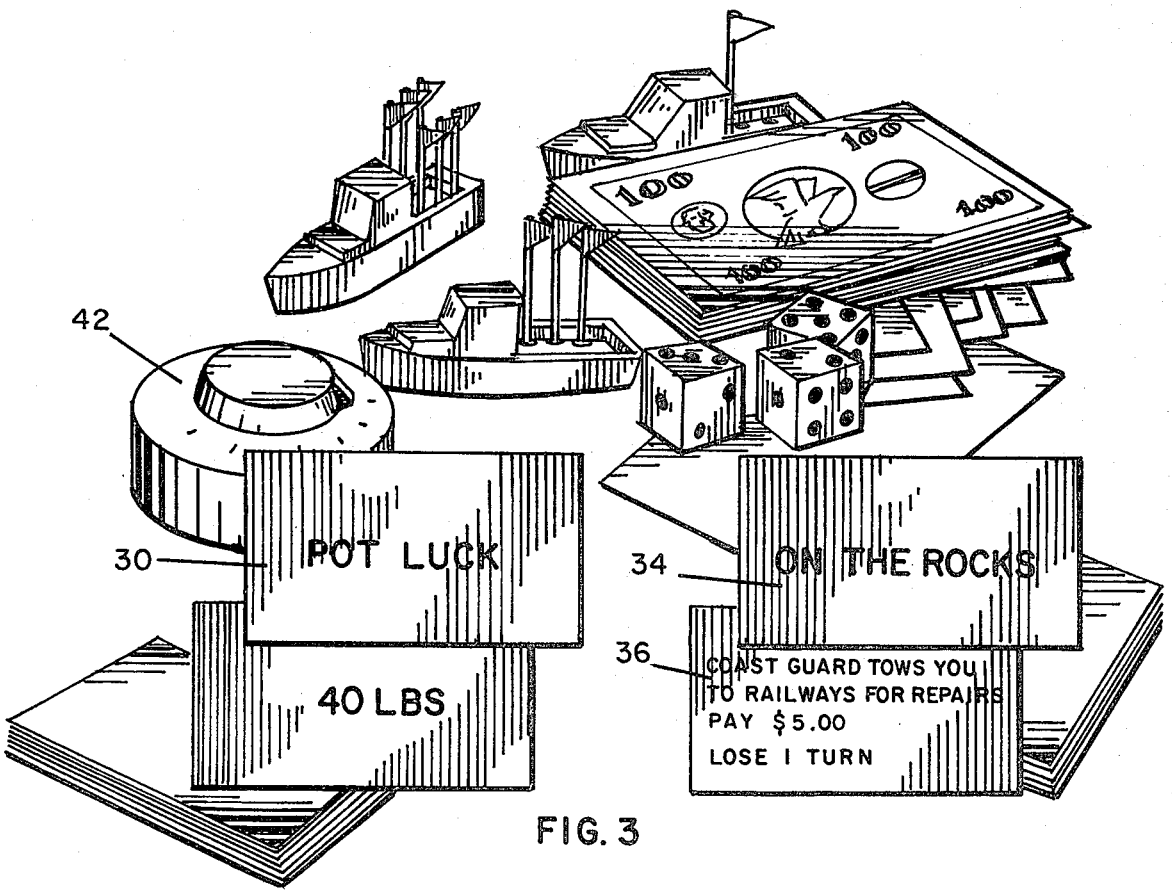
FIG. 3 illustrates a group of Pot Luck Cards, On The Rocks Cards play money, dice, and a timer.

FIG. 1 illustrates game board 10 of this invention. Disposed around three sides of the gameboard is shoreline 11, on one side of which is depicted a series of docks 12 usually six in number, which extend out into the water area. Within one of the docks is seen a lobster boat playing piece 26. A breakwater 18 extends from the side of the gameboard out into the harbor-like area formed by shoreline 11 around three sides of the board. The fourth side of the gameboard can be left open so that it appears to extend out toward the ocean. A repair facility of a marine railway 20 is depicted on a section of the gameboard. At the center of the board is an island 16 upon which the Pot Luck Cards 30 and the On The Rocks Cards 34 are positioned. A grid 14 is superimposed on the surface of the water area of the gameboard. This grid can form rectangular spaces so as to allow only for horizontal and vertical moves as is disclosed herein. In an alternative embodiment a grid forming square spaces can be utilized enabling diagonal moves to be made if the players of the game wish such a full range of movement. The grid does not extend to the area around the docks and this area is designated as a free area 13 from which a player, when it is his turn to leave the dock, may leave the dock and enter the grid spaces at any desired point along this area. A plurality of rocks 22 are disposed within certain spaces of the grid. These are usually designated near the lobster trap receipt areas 24. Such areas may merely be spots on the board or may be apertures formed within the gameboard itself for receipt of lobster trap indicia 28 such as the indicia seen in FIG. 2 on lobster boat 26. These indicia 28 are post indicia colored to match the colors of the boats, each player having a particular color so that he can recognize his lobster trap indicia 28. In the embodiment illustrated, the lobster trap indicia are inserted within apertures in the lobster boats and these lobster trap flag-like indicia may be removed when the boat is adjacent to a lobster trap receipt area 24 and inserted into the lobster trap receipt area 24 as seen in FIG. 2. Also visible in FIG. 2 is rock 22 as well as grid spaces 14. As discussed above, it should be noted that the lobster trap indicia may have other forms and can even be in the shape of lobster traps and be merely placed onto a designated spot on the board. It has been found, however, that the embodiment depicted herein works very well in actual playing. As in real-life lobstering, lobster trap indicia resemble lobster buoys which also have a portion thereof with a hightly colored float which sticks upwards out of the water. As mentioned above, when one retrieves a lobster trap, one selects a card from the Pot Luck Cards deck depicted in FIG. 3. Two of such cards are illustrated in FIG. 3 showing what might be written thereon such as "5 pounds of lobsters caught" or "25 pounds". A certain amount of money 38 is distributed to each player to pay for expenses arising during the game such as bait fees, fuel fees, taxes, licenses, etc. The chance selection means utilized in this game are dice, either used singly to determine the lobster price per pound or in a pair to determine the length of movement of a lobster boat playing piece. When a lobster boat playing piece becomes stranded at a low tide on a rock when the timer 42 illustrated in FIG. 3 runs for the 15 minute period, the stranded player must pick a card from the On The Rocks Deck 34 to find out the fate of the boat. Two of such cards 36 are also depicted in FIG. 3. For example, the boat may have a damaged bottom and have to be towed by the Coast Guard to the marine railway 20 and the player have to pay substantial fees for repairs as stated on the card, or the boat may merely have to have its bottom inspected by a diver and the player have to pay a lower fee. These cards are also shuffled at the end of each trip and designate many different fates for a lobster boat caught on the rocks. The game continues for the number of trips determined at the beginning of the game at which time a winner is declared.

Although the present invention has been described with reference to particular embodiments, it will be apparent to those skilled in the art that variations and modifications can be substituted therefor without departing from the principles and spirit of the invention.

I claim:

1. A game for at least two players comprising the steps of:

providing a board having a portion thereof depicting water with a grid of lines interposed thereover defining a plurality of spaces with a portion of said board further depicting around at least three edges shoreline with at least one dockage area;

providing at least one player piece in the shape of a lobster boat including means for carrying lobster trap indicia for movement on the spaces of water between said grid lines;

providing lobster trap indicia for placement on preselected of said spaces of water;

providing indication means for determining the weight of lobsters to be caught in said lobster trap indicia providing rock indicia means on selected of said spaces of water;

providing high and low tide time indication means and means for determining the fate of a player piece positioned on a space having rock indicia means during low tide;

providing lobster trap position indicator means on preselected spaces;

providing a timer as said indication means for indicating periods of high tide and low tide, chance number selection means, and money indicia;

receiving by a player of a predetermined amount of money indicia;

determining by a player by said chance number selection means the price of lobster;

activating by a player said timing means to indicate the period of high tide;

determining by a player by said chance number selection means the number of spaces his lobster boat shall move;

moving by a player said lobster boat to said space starting on the first move from said dock;

depositing by a player a lobster trap indicia if desired upon a space having lobster trap receipt means if such space is adjacent to the space said lobster boat is on;

returning said lobster boat by a player by said chance selected number of moves to said dock after setting all of said traps;

recovering by a player all of said traps by moving in a desired direction said chance-selected number of moves; at the end of the period of high tide, each player whose lobster boat is on a space having rock indicia means thereon being assigned a fate through actuation of the fate determining means;

determining the weight of lobster in each trap after returning it to said dock by selecting one of said weight indication means; and determining the price of the lobster in each trap by comparing the weight of the lobster therein and the determined price of lobster.

2. The game as described in claim 1 further including resetting said timing means at the end of said high tide period to a new time period for low tide.

* * * * *